US008939720B2

(12) United States Patent
Rodrigues

(10) Patent No.: US 8,939,720 B2
(45) Date of Patent: Jan. 27, 2015

(54) VOLUTE SHAPED PUMP CASING FOR A CENTRIFUGAL PUMP

(75) Inventor: Arnaldo Rodrigues, Winterthur (CH)

(73) Assignee: Sulzer Pumpen AG, Winterthur (CH)

( * ) Notice: Subject to any disclaimer, the term of this patent is extended or adjusted under 35 U.S.C. 154(b) by 575 days.

(21) Appl. No.: 13/157,759

(22) Filed: Jun. 10, 2011

(65) Prior Publication Data

US 2011/0311357 A1 Dec. 22, 2011

(30) Foreign Application Priority Data

Jun. 18, 2010 (EP) ..... 10166566

(51) Int. Cl.
*F04D 29/42* (2006.01)
*F04D 29/44* (2006.01)

(52) U.S. Cl.
CPC ..... *F04D 29/448* (2013.01)
USPC ..... 415/206

(58) Field of Classification Search
USPC ..... 415/203, 204, 205, 206, 207, 182.1, 415/143, 212.1
See application file for complete search history.

(56) References Cited

U.S. PATENT DOCUMENTS

2001/0014290 A1* 8/2001 Takura et al. ..... 417/371

FOREIGN PATENT DOCUMENTS

| | | | |
|---|---|---|---|
| EP | 1 126 176 | A2 | 8/2001 |
| GB | 555308 | A | 8/1943 |
| GB | 2 069 607 | A | 8/1981 |
| GB | 2 412 695 | A | 10/2005 |

* cited by examiner

*Primary Examiner* — Ninh H Nguyen
*Assistant Examiner* — Maxime Adjagbe
(74) *Attorney, Agent, or Firm* — Kilpatrick Townsend & Stockton LLP

(57) ABSTRACT

A volute shaped pump casing (1) for a centrifugal pump includes a chamber for housing at least one impeller (4) mounted on a shaft (2) for rotating the impeller around an axis of rotation (2*a*), a volute shaped chamber which forms a flow channel divided into a first volute (5.1) and a second volute (5.2), and a first channel (6.1) and a second channel (6.2) connected to the first and the second volute respectively. The first channel is also called long channel and the second channel is also called short channel. In the volute shaped pump casing (1), the first or long channel (6.1) is axially displaced with respect to the second or short channel (6.2) and/or with respect to the second volute (5.2).

13 Claims, 2 Drawing Sheets

- -PRIOR ART- -

C'-C'
- -PRIOR ART- -

- -PRIOR ART- -

- -PRIOR ART- -

VOLUTE SHAPED PUMP CASING FOR A CENTRIFUGAL PUMP

CROSS-REFERENCES TO RELATED APPLICATIONS

This application claims the priority of European Application No. 10 166 566.9, filed Jun. 18, 2010, the disclosure of which is incorporated herein by reference.

BACKGROUND OF THE INVENTION

The invention relates to a volute shaped pump casing according to the preamble of claim 1 and to a centrifugal pump including such a volute shaped pump casing.

Volute casing pumps are very common. Their characteristic feature is the volute-shaped pump casing which, as a rule, makes this pump type recognizable from the outside. Volute type casings can be built as part of a single stage or multistage pump arrangement. In some multistage pumps a volute shaped casing is provided only for the last stage. Single suction and double suction, double volute casing pumps are both used frequently.

A volute shaped casing generally includes a chamber designed to house at least one impeller being usually of the radial or mixed flow type and mounted on a shaft for rotation when driven by a motor. The casing further includes a volute shaped chamber to collect pumped medium and a channel and discharge section to guide the medium out. The discharge can be arranged tangentially to the volute casing, or arranged radially by providing a swan neck. A suction channel section is favorably arranged axially in case of bearings arranged only at one side of the impeller, and radially or tangentially in case of bearings at either side of the impeller.

In its simplest embodiment of a single volute, the casing can be broadly sub-divided into two main sections consisting of a downstream chamber section including a volute shaped chamber and the upstream channel and discharge section. The plane or section at which the volute and channel meet is generally defined as the throat. The leading edge of the throat which separates or guides the flow from the chamber into the channel is designated cutwater lip or cut water and for any given length the top and bottom surface extending beyond the lip is termed the tongue. In the case of a casing with a plurality of volutes and flow channels disposed around an impeller the number of lips will usually be equal to the number of volutes or flow channels. I.e., in case of a double volute there will be two lips.

The conventional pump casing with double volute and double discharge is arranged in such a way that an outer or long channel connected to a first volute is wrapped around a second or inner volute and over a short channel connected to the second volute so that the discharge of the pumped medium is made through a common discharge nozzle which can e.g. be provided in a flange. This provides effective pumping means but imposes a large area envelope in radial direction and, thus, an increased height which is disadvantageous for pump arrangements requiring a more compact solution.

A current example of such a pump arrangement is a two-stage pump with two impellers mounted back-to-back on a shaft and separated by a centre-bush secured to the shaft, with one impeller mounted in a stage casing and the other in a discharge casing. The intake to the discharge casing is made via a top and a bottom crossover channel which respectively cross over and under the stage casing and the discharge casing. The cross sections of the crossover channels join at the intake opening of the discharge casing.

The height imposed by the conventional double volute casing signifies a disadvantageous overall pump height and a large distance between the crossover channels and the centre-bush, with the casing part of the centre-bush being made up of a large mass of material. This furthermore results in additional large pockets of material mass between the crossover channels and the neighboring contours of the casing. Thus, from a cost standpoint, the greater height of the conventional double volute casing leads to increased mass in the described multistage embodiment and therefore to a more expensive solution.

BRIEF SUMMARY OF THE INVENTION

It is an object of the present invention to provide a volute shaped pump casing with two or more volutes and a centrifugal pump including such a volute shaped pump casing which have a geometric envelope that is smaller in the radial direction than the geometric envelope of a conventional double volute casing of an equally rated pump and which have a bolting line closer to the axis of rotation than the bolting line in a conventional double volute casing of an equally rated pump. Another object of the invention applied to multistage pumps is to reduce the material mass of the volute shaped pump casing in comparison with a conventional double volute casing of an equally rated multistage pump.

This object is satisfied in accordance with the invention by the volute shaped pump casing defined in claim 1 and by the centrifugal pump defined in claim 9.

The volute shaped pump casing for a centrifugal pump according to the invention includes a chamber for housing at least one impeller mounted on a shaft for rotating the impeller around an axis of rotation, a volute shaped chamber which forms a flow channel divided into a first volute and a second volute, and a first channel and a second channel connected to the first and the second volute respectively, with the first channel being called long channel and the second channel being called short channel. The volute shaped pump casing is characterized in that the first or long channel is axially displaced with respect to the second or short channel and/or with respect to the second volute, for example in that the first or long channel is axially displaced over more than half of its length with respect to the second or short channel and/or with respect to the second volute. A final part of the long channel can e.g. be arranged in the axial direction at the side of the short channel or side by side with the short channel.

In an advantageous embodiment variant the first and the second volute is connected to a single channel each. In a further advantageous embodiment variant the channels have a final part each which form a double discharge.

In an advantageous embodiment the first or longer channel has a wall closer to the axis of rotation called inner wall in the following, wherein a radial distance between the axis of rotation and the inner wall decreases over at least a part of the length of the long channel. In a further advantageous embodiment a radial distance between the axis of rotation and the inner wall of the long channel is smaller than the radius of the impeller over a part of the length of the long channel. In another advantageous embodiment the volute shaped pump casing comprises an inlet duct and, over a part of the length of the long channel, a radial distance between the axis of rotation and the inner wall of the long channel is smaller than half of the diameter of the inlet duct or smaller than half of the smallest diameter of the inlet duct.

Independent of the embodiment or embodiment variant, the long channel and/or the short channel can have a constant cross section over part of their respective length or a widening cross section over part of their respective length. Moreover, the long channel and/or the short channel can have a constant cross section over the greater part of their respective length or a widening cross section over the greater part of their respective length.

The centrifugal pump according to the invention includes at least one impeller mounted on a shaft for rotating the impeller around an axis of rotation and a volute shaped pump casing according to one or more of the embodiments and embodiment variants described above. The centrifugal pump is typically of the radial type or of the mixed flow type.

In an advantageous embodiment the centrifugal pump is a multistage pump. In an advantageous embodiment variant the centrifugal pump is a multistage pump including a back to back impeller arrangement and a discharge stage, wherein the long channel of the discharge stage passes in-between a center-bush and a crossover of the multistage pump.

The volute shaped pump casing and the centrifugal pump according to the invention have the advantage that the geometric envelope of the volute shaped pump casing and, consequently, of the centrifugal pump in the radial direction can be made smaller, e.g. 90% or 80% of that of an equally rated conventional double volute pump. In the practice, this typically means an overall reduction in the casing height. It is further advantageous that the sitting position of the pump according to the invention can be made lower in relation to its mounting position and that the bolting line can be arranged closer to the axis of the pump than in an equally rated conventional double volute pump.

Another advantage of the volute shaped pump casing and the centrifugal pump according to the invention relates to multistage pumps in which the material mass of the volute shaped pump casing can be reduced in comparison with a conventional double volute casing of an equally rated conventional multistage pump. In the volute shaped pump casing according to the invention it is in particular possible to reduce the material mass or thickness between the casing hydraulic geometry and that of the neighboring geometry contours. In a multistage pump according to the invention it is possible to decrease the distance between top and bottom crossover thereby reducing the overall height of the entire pump compared to conventional multistage pumps. A more compact solution is thus achieved by the volute shaped pump casing and the centrifugal pump according to the invention.

The above description of the embodiments and variants serves merely as an example. Further advantageous embodiments can be seen from the dependent claims and the drawing. Moreover, in the context of the present invention, individual features from the described or illustrated embodiments and from the described or illustrated variants can be combined with one another in order to form new embodiments.

In the following the invention will be explained in more detail with reference to the specific embodiment and with reference to the drawing.

DETAILED DESCRIPTION OF THE INVENTION

Figure 1:
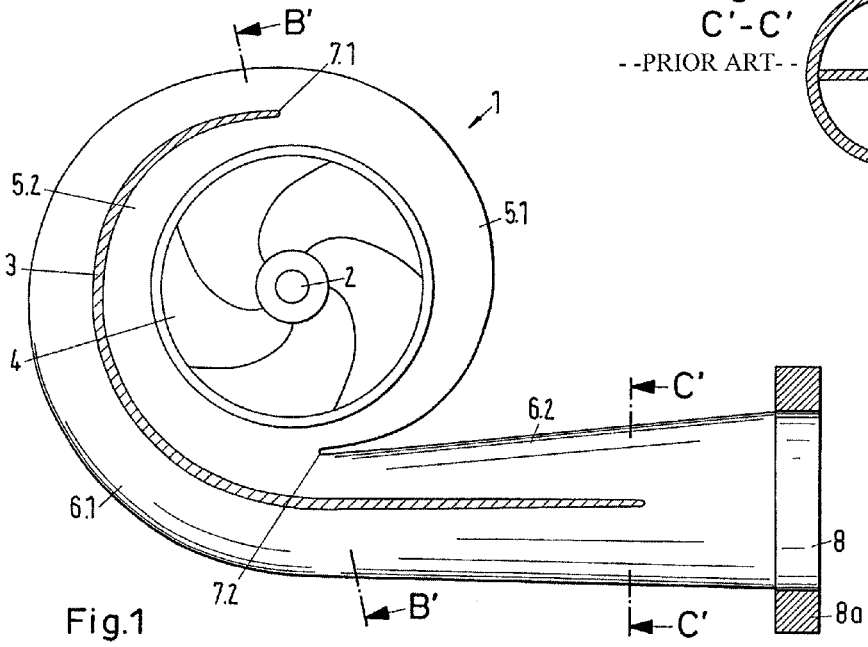
FIG. 1 is a section perpendicular to the axis of rotation through a conventional volute shaped pump casing having a double volute.
Figure 1A:
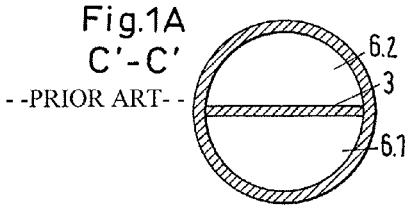
FIG. 1A is a cross section through the outlet part of the conventional volute shaped pump casing in accordance with FIG. 1.
Figure 3:
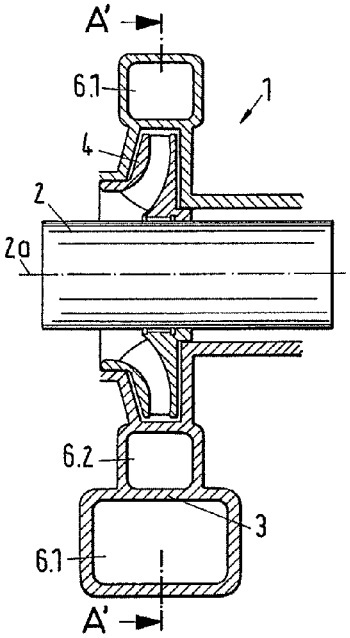
FIG. 3 is an axial section through the conventional volute shaped pump casing in accordance with FIG. 1.

FIGS. 1, 1A and 3 show a conventional volute shaped pump casing 1 for a centrifugal pump, with FIG. 1 being a section A'-A' perpendicular to an axis of rotation, FIG. 1A being a cross section C'-C' through the outlet part and FIG. 3 being an axial section B'-B' through the conventional volute shaped pump casing. The volute shaped pump casing shown includes a chamber for housing at least one impeller 4 mounted on a shaft 2 for rotation around an axis of rotation 2*a* when for example driven by a motor. The casing further includes a volute shaped chamber which forms a flow channel divided into a first volute 5.1 and a second volute 5.2 typically extending each over about half or less of the circle, and a first channel 6.1 and a second channel 6.2 connected to the first and the second volute respectively to guide the pumped medium out.

The casing advantageously includes at least one wall 3 separating the first channel 6.1 from the second volute 5.2 and/or from the second channel 6.2, said wall 3 being called a rib or splitter rib or splitter rib wall. A leading edge part 7.1, 7.2 of the casing 1 which separates or guides the flow from a volute 5.1, 5.2 into a channel 6.1, 6.2 is designated cutwater lip or cut water and for any given length the top and bottom surface extending beyond the lip is termed the tongue. In the case of a casing with double volutes and double flow channels there are two cutwater lips 7.1, 7.2, with one of the cutwater lips being the leading edge part of the splitter rib 3 in the casing shown in FIG. 1.

A conventional volute shaped pump casing with double volute and double discharge is arranged in such a way that the first channel 6.1, also called outer or long channel, is wrapped around the second volute 5.2, also called inner volute, and over the second channel 6.2, also called inner or short channel, so that the discharge of the pumped medium is made through a common discharge opening 8 which for example can be provided in a flange 8*a*. The final or last part of the channels 6.1, 6.2 can be arranged tangentially to the volute casing, as shown in FIG. 1 or arranged radially by providing e.g. a swan neck. The volute shaped pump casing can further include a suction duct or suction channel not shown in the Figures.

Figure 2:
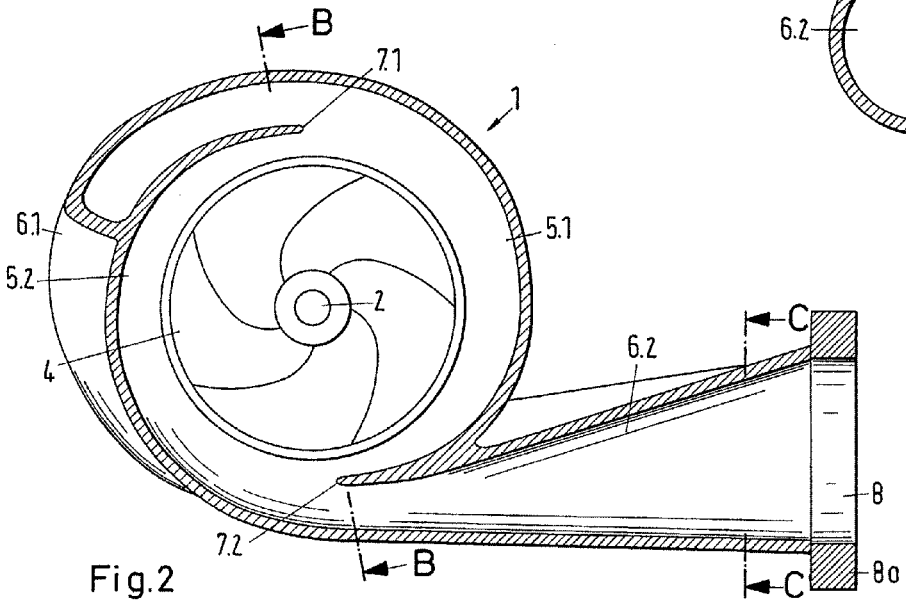
FIG. 2 is a section perpendicular to the axis of rotation through an embodiment of a volute shaped pump casing according to the invention having a double volute.
Figure 2A:
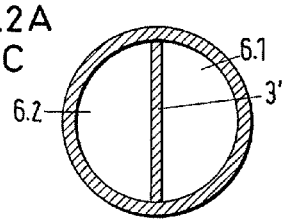
FIG. 2A is a cross section through the outlet part of the embodiment of a volute shaped pump casing according to the invention shown in FIG. 2.
Figure 4:
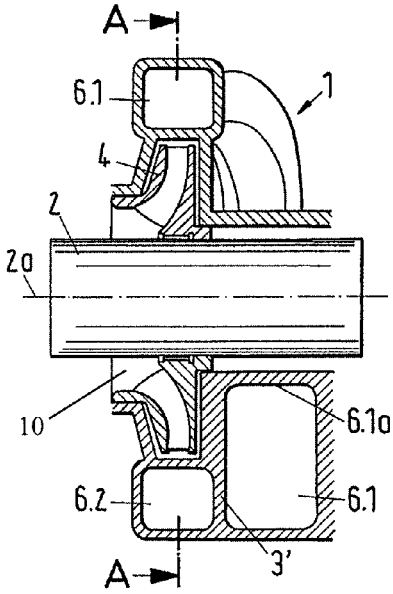
FIG. 4 is an axial section through the embodiment of a volute shaped pump casing according to the invention shown in FIG. 2.

FIGS. 2, 2A and 4 show an embodiment of a volute shaped pump casing 1 according to the invention, with FIG. 2 being a section A-A perpendicular to an axis of rotation, FIG. 2A being a cross section C-C through the outlet part and FIG. 4 being an axial section B-B through the volute shaped pump casing. In the embodiment shown, the volute shaped pump casing 1 for a centrifugal pump according to the invention includes a chamber for housing at least one impeller 4 mounted on a shaft 2 for rotating the impeller around an axis of rotation 2*a*, a volute shaped chamber which forms a flow channel divided into a first volute 5.1 and a second volute 5.2 typically extending each over about half or less of the circle, and a first channel 6.1 and a second channel 6.2 connected to the first and the second volute respectively, with the first channel 6.1 being called long channel and the second channel 6.2 being called short channel.

The volute shaped pump casing 1 according to the invention is characterized in that the first or long channel 6.1 is axially displaced with respect to the second or short channel 6.2 and/or with respect to the second volute 5.2, for example in that a greater part of or more than half of the length of the first or long channel 6.1 is axially displaced with respect to the second or short channel 6.2 and/or with respect to the second volute 5.2. A final or last part of the long channel 6.1 can e.g. be arranged in the axial direction at the side of the short channel 6.2 or side by side with the short channel 5.2.

The casing 1 advantageously includes at least one wall 3' separating the first channel 6.1 from the second volute 5.2 and/or from the second channel 6.2, said wall 3' being called a rib or splitter rib or splitter rib wall. The casing 1 can further include a leading edge part 7.1, 7.2 of the casing 1 which separates or guides the flow from a volute 5.1, 5.2 into a channel 6.1, 6.2 and which is designated cutwater lip or cut water. In the case of a casing with double volutes and double flow channels there are two cutwater lips 7.1, 7.2 as shown in FIG. 2.

In the embodiment shown in FIGS. 2, 2A and 4 the double volute arrangement is typically retained as in the conventional double volute pump casing. However, the long channel 6.1 favorably assumes a different design configuration in that e.g. the cross-sectional areas along the length of this channel are progressively displaced in the axial direction to the extent where the next cross-sectional areas are arranged closer and radially around the shaft 2 and to the side of the short channel 6.2. The last cross-section each of the long channel 6.1 and of the short channel typically join a common discharge duct provided with a opening 8 and optionally with a flange 8*a*. The final or last part of the channels 6.1, 6.2 can be arranged tangentially to the volute casing, as shown in FIG. 2 or arranged radially by providing e.g. a swan neck. The volute shaped pump casing can further include a suction duct or suction channel not shown in the Figures.

In an advantageous embodiment variant the first and the second volute 5.1, 5.2 is connected to a single channel 6.1, 6.2 each. In a further advantageous embodiment variant the channels 6.1, 6.2 have a final or last part each which form a double discharge as shown in FIG. 2A.

In an advantageous embodiment the first or longer channel 6.1 has a wall closer to the axis of rotation 2*a* called inner wall 6.1*a* in the following, wherein a radial distance between the axis of rotation 2*a* and the inner wall 6.1*a* decreases over at least a part of the length of the long channel 6.1. In a further advantageous embodiment a radial distance between the axis of rotation 2*a* and the inner wall 6.1*a* of the long channel 6.1 is smaller than the radius of the impeller 4 over a part of the length of the long channel. In another advantageous embodiment the volute shaped pump casing comprises an inlet duct 10 and, over a part of the length of the long channel 6.1, a radial distance between the axis of rotation 2*a* and the inner wall 6.1*a* of the long channel is smaller than half of the diameter of the inlet duct 10 or smaller than half of the smallest diameter of the inlet duct 10. The inner wall 6.1*a* of the long channel 6.1 does not need to be straight as shown in FIG. 4 but, in practice, can assume any appropriate shape in an axial cross section such as a circular, oval or curved shape.

Independent of the embodiment or embodiment variant, the long channel 6.1 and/or the short channel 6.2 can have a constant cross section over part of their respective length or a widening cross section over part of their respective length. Moreover, the long channel and/or the short channel can have a constant cross section over the greater part of their respective length or a widening cross section over the greater part of their respective length.

Figure 5:
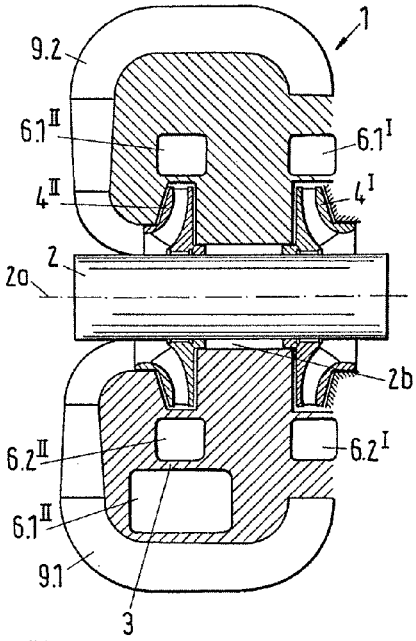
FIG. 5 is an axial section through a conventional volute shaped pump casing having two stages and a double volute.
Figure 6:
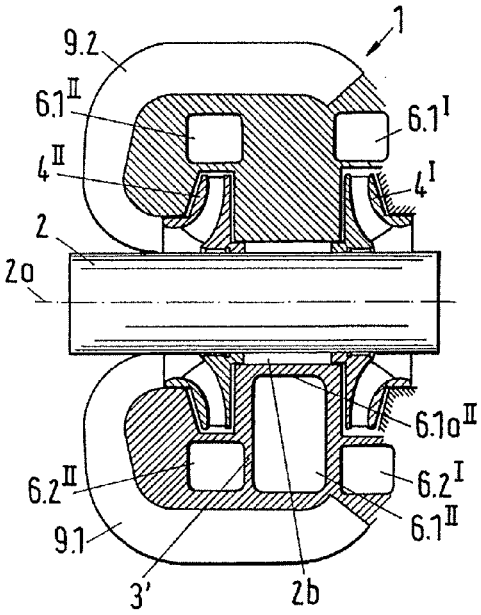
FIG. 6 is an axial section through a second embodiment of a volute shaped pump casing according to the invention having two stages and a double volute.

FIG. 5 shows an axial section through a conventional volute shaped pump casing having two stages and a double volute; and FIG. 6 shows an axial section through a second embodiment of a volute shaped pump casing according to the invention having two stages and a double volute. The conventional volute shaped pump casing 1 shown in FIG. 5 includes a first stage and a second or discharge stage each with a chamber for housing an impeller $\mathbf{4}^{I}$, $\mathbf{4}^{II}$ mounted on a common shaft 2 for rotation around an axis of rotation 2*a* when for example driven by a motor. The impellers $\mathbf{4}^{I}$, $\mathbf{4}^{II}$ are typically mounted in a back-to-back arrangement on the shaft 2 and separated by a center-bush 2*b*.

The first stage of the conventional volute shaped pump casing includes a flow channel for collecting the pumped medium and a first channel $\mathbf{6.1}^{I}$ and a second channel $\mathbf{6.2}^{I}$ connected each to the flow channel to convey the pumped medium while the discharge stage includes a volute shaped chamber which forms a flow channel divided into a first volute and a second volute typically extending each over about half or less of the circle, and a first channel $\mathbf{6.1}^{II}$ and a second channel $\mathbf{6.2}^{II}$ connected to the first and the second volute respectively to guide the pumped medium out. The discharge stage advantageously includes at least one splitter rib wall 3 separating the first channel $\mathbf{6.1}^{II}$ from the second volute and/or from the second channel $\mathbf{6.2}^{II}$ of the discharge stage. The channels $\mathbf{6.1}^{I}$, $\mathbf{6.2}^{I}$ of the first stage are respectively connected via crossover channels 9.1, 9.2 such as a top and a bottom crossover channel to the intake opening of the discharge stage.

In a conventional volute shaped pump casing having two stages and a double volute the first channel $\mathbf{6.1}^{II}$ of the discharge stage is wrapped around the second volute and over the second channel $\mathbf{6.2}^{II}$ of the discharge stage so that the discharge of the pumped medium is made through a common discharge opening. The volute shaped pump casing can further include a suction duct or suction channel not shown in FIG. 5.

The second embodiment of a volute shaped pump casing 1 according to the invention as shown in FIG. 6 includes a first stage and at least a second or discharge stage. Each stage has a chamber for housing an impeller $\mathbf{4}^{I}$, $\mathbf{4}^{II}$ mounted on a common shaft 2 for rotation around an axis of rotation 2*a* when for example driven by a motor. The impellers $\mathbf{4}^{I}$, $\mathbf{4}^{II}$ are typically mounted in a back-to-back arrangement and separated by a center-bush 2*b* on the shaft 2.

The first stage of the second embodiment includes a flow channel for collecting the pumped medium and a first channel $\mathbf{6.1}^{I}$ and a second channel $\mathbf{6.2}^{I}$ connected each to the flow channel while the discharge stage includes a volute shaped chamber which forms a flow channel divided into a first volute and a second volute typically extending each over about half or less of the circle, and a first channel $\mathbf{6.1}^{II}$ and a second channel $\mathbf{6.2}^{II}$ connected to the first and the second volute respectively, with the first channel $\mathbf{6.1}^{II}$ being called long channel and the second channel $\mathbf{6.2}^{II}$ being called short channel.

In the volute shaped pump casing 1 according to the second embodiment the first or long channel $\mathbf{6.1}^{II}$ of the discharge stage is axially displaced with respect to the second or short channel $\mathbf{6.2}^{II}$ of the discharge stage and/or with respect to the second volute of the discharge stage, for example in that a greater part of or more than half of the length of the first or long channel 6.1$^{II}$ is axially displaced with respect to the second or short channel 6.2$^{II}$ and/or with respect to the second volute. A final or last part of the long channel 6.1$^{II}$ of the discharge stage can e.g. be arranged in the axial direction at the side of the short channel 6.2$^{II}$ of the discharge stage or side by side with the short channel of the discharge stage.

The discharge stage advantageously includes at least one splitter rib wall 3' separating the first channel 6.1$^{II}$ of the discharge stage from the second volute of the discharge stage and/or from the second channel 6.2$^{II}$ of the discharge stage. The channels 6.1$^{I}$, 6.2$^{I}$ of the first stage are respectively connected via crossover channels 9.1, 9.2 such as a top and a bottom crossover channel to the intake opening of the discharge stage.

In the second embodiment shown in FIG. 6 the double volute arrangement is typically retained as in the conventional double volute pump casing. However, the long channel 6.1$^{II}$ of the discharge stage favorably assumes a different design configuration in that e.g. the cross-sectional areas along the length of this channel are progressively displaced in the axial direction to the extent where the next cross-sectional areas are arranged closer and radially around the shaft 2 and to the side of the short channel 6.2$^{II}$ of the discharge stage. The last cross-section each of the long channel 6.1$^{II}$ of the discharge stage and of the short channel 6.2$^{II}$ of the discharge stage typically joins a common discharge duct. The volute shaped pump casing 1 of the second embodiment can further include a suction duct or suction channel not shown in FIG. 6.

In an advantageous embodiment variant the first and the second volute of the discharge stage is connected to a single channel 6.1$^{II}$, 6.2$^{II}$ each. In a further advantageous embodiment variant the channels 6.1$^{II}$, 6.2$^{II}$ of the discharge stage have a final or last part each which form a double discharge.

In another advantageous embodiment variant the long channel 6.1$^{II}$ of the discharge stage passes in-between a center-bush 2*b* and a crossover 9.1, 9.2 of the volute shaped pump casing 1.

In an advantageous embodiment the first or longer channel 6.1$^{II}$ of the discharge stage has a wall closer to the axis of rotation 2*a* called inner wall 6.1*a*$^{II}$ in the following, wherein a radial distance between the axis of rotation 2*a* and the inner wall 6.1*a*$^{II}$ decreases over at least a part of the length of the long channel 6.1$^{II}$ of the discharge stage. In a further advantageous embodiment a radial distance between the axis of rotation 2*a* and the inner wall 6.1*a*$^{II}$ of the long channel 6.1$^{II}$ of the discharge stage is smaller than the radius of the impeller 4$^{II}$ of the discharge stage over a part of the length of the long channel. In another advantageous embodiment the volute shaped pump casing comprises an inlet duct and, over a part of the length of the long channel 6.1$^{II}$ of the discharge stage, a radial distance between the axis of rotation 2*a* and the inner wall 6.1*a*$^{II}$ of the long channel of the discharge stage is smaller than half of the diameter of the inlet duct or smaller than half of the smallest diameter of the inlet duct. The inner wall 6.1*a*$^{II}$ of the long channel 6.1$^{II}$ of the discharge stage does not need to be straight as shown in FIG. 6 but, in practice, can assume any appropriate shape in an axial cross section such as a circular, oval or curved shape.

The invention further includes a centrifugal pump which is provided with at least one impeller 4 mounted on a shaft 2 for rotating the impeller around an axis of rotation 2*a* and with a volute shaped pump casing 1 according to one or more of the embodiments and embodiment variants described above (see FIGS. 2, 2A and 4 and FIG. 6 regarding reference numbers). The centrifugal pump according to the invention is typically of the radial type or of the mixed flow type.

In an advantageous embodiment the centrifugal pump is a multistage pump. In an advantageous embodiment variant the centrifugal pump is a multistage pump including a back to back impeller arrangement 4$^{I}$, 4$^{II}$ and a discharge stage, wherein the long channel 6.1$^{II}$ of the discharge stage passes in-between a center-bush 2*b* and a crossover 9.1, 9.2 of the multistage pump (see FIG. 6 regarding reference numbers).

Compared to prior art the volute shaped pump casing and the centrifugal pump according to the invention have the advantage that they are able to provide a more compact solution in the radial direction and, when applied to multistage pumps, a more economic material usage.

The invention claimed is:

1. A volute shaped pump casing for a centrifugal pump, including a chamber for housing at least one impeller mounted on a shaft for rotating the impeller around an axis of rotation, a volute shaped chamber which forms a flow channel divided into a first volute and a second volute, and a first channel and a second channel connected to the first and the second volute respectively, with the first channel being called long channel and the second channel being called short channel, characterized in that the first or long channel is axially displaced with respect to the second or short channel and/or with respect to the second volute, wherein the first or longer channel has a wall closer to the axis of rotation called inner wall, and wherein a radial distance between the axis of rotation and the inner wall decreases over at least a part of the length of the long channel.

2. The volute shaped pump casing according to claim 1, wherein a final part of the long channel is arranged in the axial direction at the side of the short channel or side by side with the short channel.

3. The volute shaped pump casing according to claim 1, wherein the first and the second volute is connected to a single channel each.

4. The volute shaped pump casing according to claim 1, wherein the channels have a final part each which form a double discharge.

5. The volute shaped pump casing according to claim 1, wherein the first or longer channel has a wall closer to the axis of rotation called inner wall, and wherein a radial distance between the axis of rotation and the inner wall of the long channel is smaller than the radius of the impeller over a part of the length of the long channel.

6. The volute shaped pump casing according to claim 1 comprising an inlet duct, wherein the first or longer channel has a wall closer to the axis of rotation called inner wall in the following, and wherein over a part of the length of the long channel, a radial distance between the axis of rotation and the inner wall of the long channel is smaller than half of the diameter of the inlet duct, in particular smaller than half of the smallest diameter of the inlet duct.

7. The volute shaped pump casing according to claim 1, wherein the long channel and/or the short channel have a constant cross section over the greater part of their respective length or a widening cross section over the greater part of their respective length.

8. A centrifugal pump including at least one impeller mounted on a shaft for rotating the impeller around an axis of rotation and a volute shaped pump casing according to claim 1.

9. The centrifugal pump according to claim 8, wherein the centrifugal pump is of the radial type or of the mixed flow type.

10. The centrifugal pump according to claim 8, wherein the centrifugal pump is a multistage pump.

11. The centrifugal pump according to claim 10, wherein the centrifugal pump is a multistage pump including a back to back impeller arrangement and a discharge stage, and wherein the long channel of the discharge stage passes in-between a center-bush and a crossover of the multistage pump.

12. A volute shaped pump casing for a centrifugal pump, the pump comprising at least one impeller and a shaft, wherein the impeller is mounted on the shaft, wherein the shaft is configured to rotate the impeller around an axis of rotation, wherein the axis of rotation defines an axial direction, the pump casing comprising:

a chamber configured to house the impeller therein; and a volute shaped chamber defining a flow channel, wherein the flow channel comprises:

a first volute;

a second volute downstream of the first volute and at substantially the same axial position as the first volute;

a first channel fluidly connected to the first volute downstream of the first volute, in parallel with the second volute, wherein the first channel comprises an inner wall near the axis of rotation, and wherein a radial distance between the axis of rotation and the inner wall decreases over at least a part of a length of the first channel; and a second channel fluidly connected to the second volute downstream of the second volute;

wherein the first channel is displaced in the axial direction with respect to at least one of:

the second channel; and the second volute.

13. A centrifugal pump, comprising:

at least one impeller;

a shaft, wherein the impeller is mounted on the shaft, wherein the shaft is configured to rotate the impeller around an axis of rotation, wherein the axis of rotation defines an axial direction; and a volute shaped pump casing, comprising:

a chamber, wherein the impeller is housed within the chamber; and a volute shaped chamber defining a flow channel, wherein the flow channel comprises:

a first volute;

a second volute downstream of the first volute and at substantially the same axial position as the first volute;

a first channel fluidly connected to the first volute downstream of the first volute, in parallel with the second volute, wherein the first channel comprises an inner wall near the axis of rotation, and wherein a radial distance between the axis of rotation and the inner wall decreases over at least a part of a length of the first channel; and a second channel fluidly connected to the second volute downstream of the second volute;

wherein the first channel is displaced in the axial direction with respect to at least one of:

the second channel; and the second volute.

* * * * *